US010159856B1

(12) United States Patent
Wilke et al.

(10) Patent No.: US 10,159,856 B1
(45) Date of Patent: Dec. 25, 2018

(54) APPARATUS AND METHOD FOR REPLACING AN AIR FILTER OF AN AIR FILTRATION MASK

(71) Applicant: U.S. Army Edgewood Chemical and Biological Command, Washington, DC (US)

(72) Inventors: Douglas E. Wilke, Joppa, MD (US); Steven A. Yurechko, Abingdon, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 878 days.

(21) Appl. No.: 14/302,801

(22) Filed: Jun. 12, 2014

Related U.S. Application Data

(60) Provisional application No. 61/901,131, filed on Nov. 7, 2013.

(51) Int. Cl.

| | |
|---|---|
| ***A62B 7/02*** | (2006.01) |
| ***A62B 7/10*** | (2006.01) |
| ***A62B 18/00*** | (2006.01) |
| ***A62B 18/02*** | (2006.01) |
| ***A62B 18/10*** | (2006.01) |
| ***A62B 23/02*** | (2006.01) |

(52) U.S. Cl.
CPC ..... *A62B 7/10* (2013.01); *A62B 7/02* (2013.01); *A62B 18/006* (2013.01); *A62B 18/02* (2013.01); *A62B 18/10* (2013.01); *A62B 23/025* (2013.01)

(58) Field of Classification Search
CPC ..... A62B 18/006; A62B 18/02; A62B 18/025; A62B 18/04; A62B 18/0045; A62B 18/10; A62B 19/00; A62B 23/02; A62B 23/025
See application file for complete search history.

(56) References Cited

U.S. PATENT DOCUMENTS

| | | | | | |
|---|---|---|---|---|---|
| 3,240,567 | A * | 3/1966 | Caparreli | A62B 19/00 | 128/205.28 |
| 4,325,364 | A * | 4/1982 | Evans | A62B 27/00 | 128/201.13 |
| 4,932,399 | A * | 6/1990 | Cappa | A62B 9/04 | 128/202.27 |
| 5,305,739 | A * | 4/1994 | Gray | A61M 16/0078 | 128/205.13 |

(Continued)

FOREIGN PATENT DOCUMENTS

| | | | | |
|---|---|---|---|---|
| DE | 3623269 A1 * | 1/1988 | ..... | A62B 18/006 |
| GB | 560877 A * | 4/1944 | ..... | A62B 18/006 |

*Primary Examiner* — Kathryn E Ditmer
(74) *Attorney, Agent, or Firm* — Ulysses John Biffoni

(57) ABSTRACT

A device for replacing an air filter of an air filtration mask in which the air filter has an inlet side adapted to be exposed to the environment and an outlet side adapted for connection to the air filtration mask. The device includes a housing having an airflow passageway with an outlet on one side of the housing and an inlet on a different outer portion of the housing. A connector detachably connects the housing to the filter so that the one side of the housing overlies at least a portion of the inlet side of the filter. An airflow mechanism, such as an impeller or source of compressed air, then creates an airflow through the airflow passageway from the housing inlet and to the housing outlet.

7 Claims, 3 Drawing Sheets

(56) References Cited

U.S. PATENT DOCUMENTS

| | | | | |
|---|---|---|---|---|
| 5,404,874 | A * | 4/1995 | Meier | A62B 18/006 128/205.12 |
| 6,050,262 | A * | 4/2000 | Jay | A62B 18/006 128/205.12 |
| 2002/0020414 | A1* | 2/2002 | Fukunaga | A61M 16/024 128/205.13 |
| 2004/0182394 | A1* | 9/2004 | Alvey | A62B 7/02 128/205.22 |
| 2005/0066966 | A1* | 3/2005 | King | A62B 18/10 128/201.23 |
| 2006/0090754 | A1* | 5/2006 | Mittelstadt | A62B 9/04 128/201.17 |
| 2007/0240716 | A1* | 10/2007 | Marx | A62B 18/006 128/204.21 |
| 2008/0127979 | A1* | 6/2008 | Becker | A62B 18/006 128/205.27 |
| 2010/0101575 | A1* | 4/2010 | Fedorko | A62B 7/10 128/204.21 |
| 2010/0122703 | A1* | 5/2010 | Daliri | A61M 16/06 128/206.17 |
| 2012/0138104 | A1* | 6/2012 | Haynam | B01D 46/2411 134/33 |

* cited by examiner

APPARATUS AND METHOD FOR REPLACING AN AIR FILTER OF AN AIR FILTRATION MASK

CROSS-REFERENCE TO RELATED APPLICATIONS

This application claims priority of U.S. Provisional Application No. 61/901,131 filed Nov. 7, 2013, the contents of which are incorporated herein by reference.

GOVERNMENT INTEREST

The invention described herein may be manufactured, used, and licensed by or for the United States Government.

BACKGROUND OF THE INVENTION

I. Field of the Invention

The present invention relates to a method and device for replacing an air filler of an air filtration mask.

II. Description of Related Art

Air filtration masks are used in a plurality of military and nonmilitary applications. Such air filtration masks are worn on the user's head and retained in position by the appropriate straps. A seal between the mask and the user ideally prevents any contamination of the air within the interior of the mask from the environment.

These air filtration masks typically contain one or more replaceable filters to filter air from the ambient environment as the air is drawn by the user into the interior of the mask. After extended use of the mask, the filters become saturated with contaminants and pollutants contained in the ambient atmosphere and must be replaced in order to restore the filtered airflow to the user. Each filter is typically detachably connected to the mask by a twist fit, such as a bayonet coupling, and, with the filter removed from the mask, a one-way valve in the mask automatically closes to prevent contaminants from the environment from entering into the mask from the area of the now removed filter.

With the filter removed, the connection port between the filter and the mask contains a number of cavities which are used to secure the filter to the mask. Consequently, with the filter removed for replacement with a clean filter, any contaminants or pollutants that are present within the ambient air enter into the cavities in the mask. When a new filter is then inserted onto the mask, these pollutants which are entrapped within the cavities in the mask enter into the interior of the mask once the new filter is installed. This creates a spike of contaminants within the interior of the mask thus reducing the overall effectiveness of the mask. For some types and concentrations of pollutants, the spike of pollutants in the interior of the mask caused by attachment of a clean filter can cause injury and even death to the user.

SUMMARY OF THE PRESENT INVENTION

The present invention provides a device which overcomes the above mentioned disadvantages of the previously known air filtration mask.

In brief, the present invention provides a device for replacing the air filter of an air filtration mask in which, as before, the filter has an inlet side adapted to be exposed to the ambient air in the environment and an outlet side adapted for connection to the air filtration mask. The device includes a housing having an airflow passageway with an outlet for the passageway on one side of the housing and an inlet to the airflow passageway on an outer portion of the housing different from the one side of the housing.

A connector then detachably connects the housing to the filter so that the side of the housing containing the airflow outlet overlies at least a portion of the inlet side of the filter. Preferably, a twist connector is used, such as a bayonet connector.

An airflow mechanism is then contained on the housing to create an airflow through the airflow passageway in the housing from the housing inlet and to the housing outlet. In one embodiment, the airflow mechanism includes an impeller that is rotatably driven by an electric motor. The motor in turn is electrically coupled to a power source, such as a battery, through a switch. When the switch is closed, the impeller is rotatably driven by the motor thus creating the airflow from the inlet and to the outlet of the airflow passageway.

In a second embodiment, a source of pressurized air, such as a pressurized air canister, is fluidly coupled to the airflow passageway through a valve. When the valve is open, compressed air flows through the airflow passageway and out through the airflow passageway outlet.

In both embodiments, the airflow outlet from the housing overlies a portion of the filter inlet so that air flows through the filter and clean air flows out through the outlet side of the filter. Consequently, as the housing with its attached filter is moved towards the filter attachment port on the air filtration mask, the clean airflow from the filter effectively removes or blows away any contaminants that may be contained within the cavities surrounding the connection port on the mask for the filter. The filter is then attached to the air filtration mask in the conventional way and the device of the present invention is removed for subsequent use in replacing a subsequent filter for the air filtration mask.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
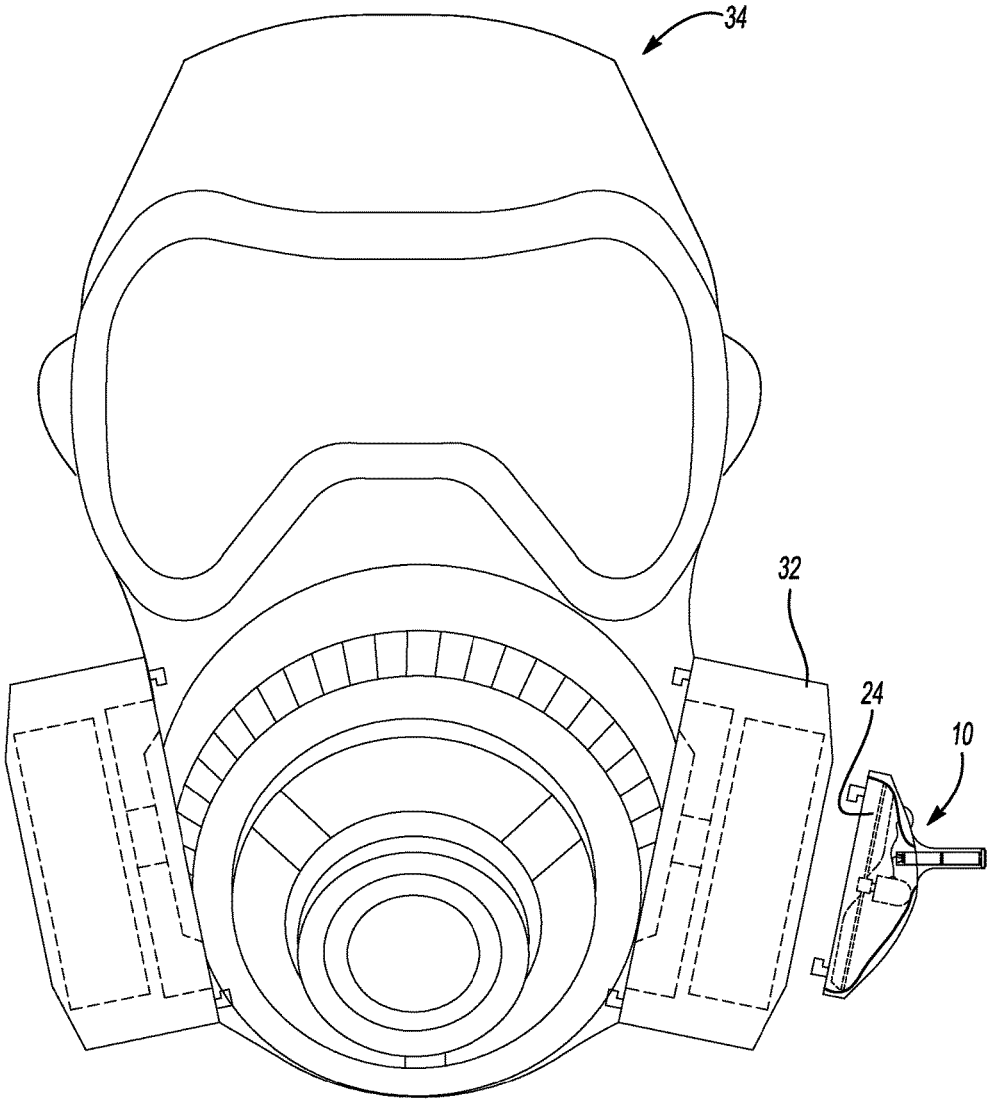
FIG. 1 is a front view of a mask and an embodiment of the device of the present invention.
Figure 2:
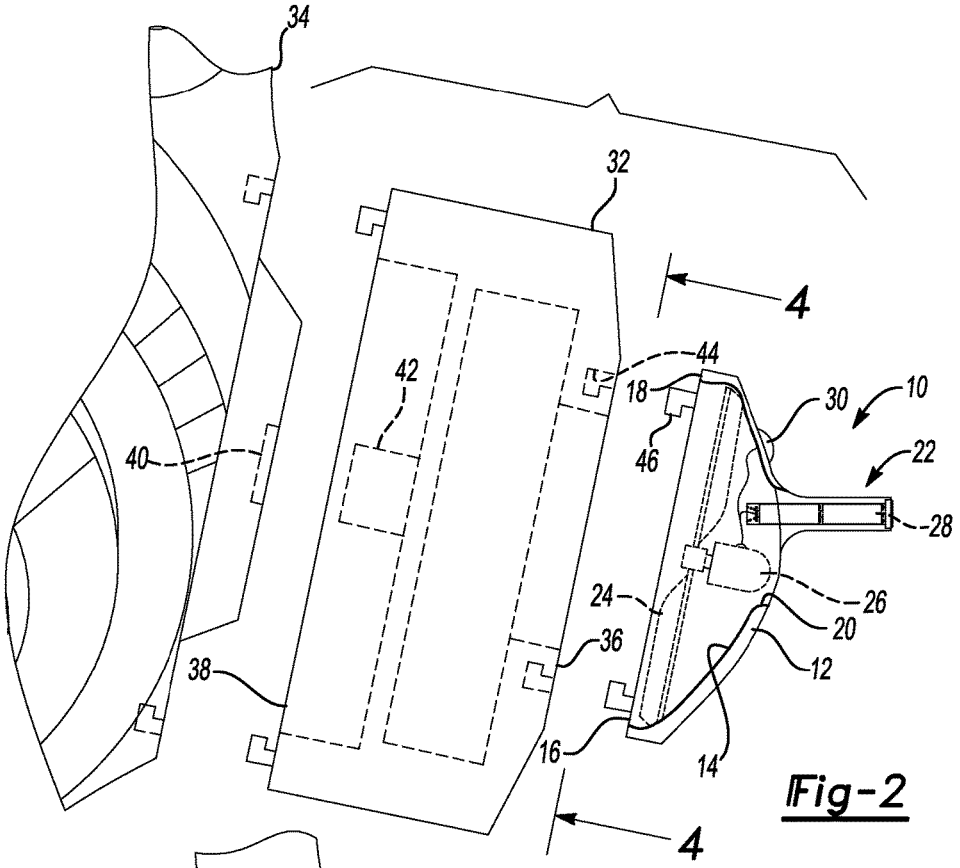
FIG. 2 is a fragmentary exploded front view of the embodiment of the device prior to attachment to the air filter.

With reference first to FIGS. 1 and 2, a first preferred embodiment of a device 10 according to the present invention is shown. The device 10 includes a housing 12 which may be constructed of any suitable material, such as a composite material, plastic material, or the like. An airflow passageway 14 is formed through the housing 12 so that an outlet 16 from the airflow passageway 14 is open to one side 18 of the housing 12. An inlet 20 of the airflow passageway 14 is open to an exterior surface of the housing 12 other than the side 18 of the housing 12.

A mechanism 22 is mounted to the housing 12 for creating an airflow through the airflow passageway 14 from its inlet 20 and to its outlet 16. As shown in FIGS. 1 and 2, the airflow mechanism 22 includes an impeller 24 which is mounted in series with the airflow passageway 14 preferably adjacent the inlet 20. Consequently, as the impeller 24 rotates, the impeller 24 inducts air from the ambient air and propels this air through the airflow passageway 14 out through the airflow passageway outlet 16.

Any conventional means may be used to rotatably drive the impeller 24. However, as shown in FIG. 2, an electric motor 26 is rotatably drivingly connected to the impeller 24. A battery 28 and electric twitch 30 are then connected in series with the electric motor 26. Thus, upon closure of the switch 30, the battery 28 provides the electric power to power the motor 26 which, in turn, rotatably drives the impeller 24.

Although a battery 28 is preferably used as the electric power source for the motor 26, it will be understood that other types of electric power sources may alternatively be used. For example, a charge capacitor or other electrical energy storage device may be used in lieu of the battery 28. Similarly, even a wound spring can be used to rotatably drive the impeller 24.

Figure 3:
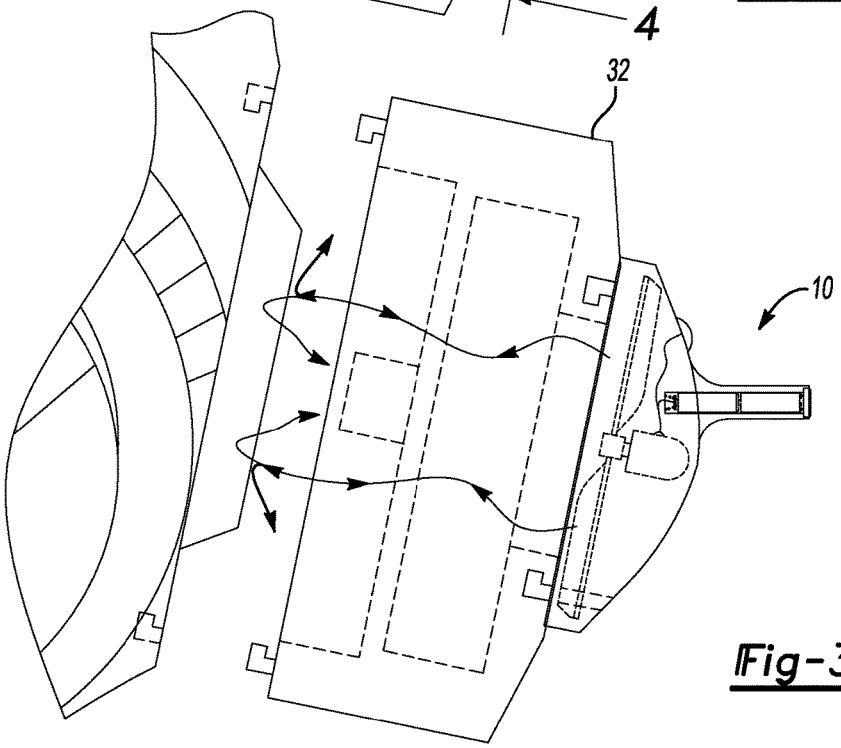
FIG. 3 is a view similar to FIG. 2 but showing the device attached to the air filter.
Figure 4:
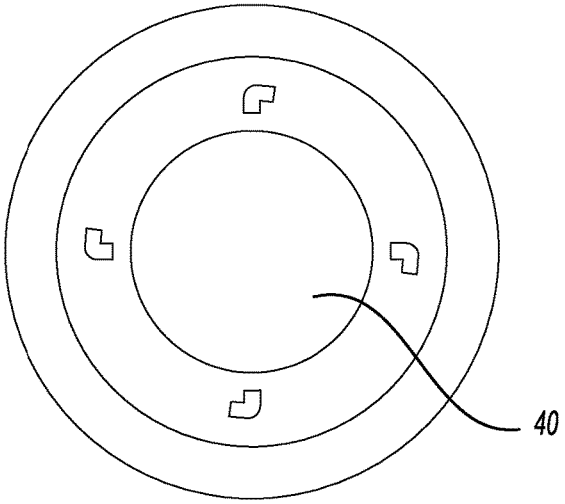
FIG. 4 is a view taken along line 4-4 in FIG. 2.

With reference now to FIGS. 2-4, an air filter 32 of the type used with an air filtration mask 34 (FIG. 1) is shown. The air filter 32 includes an inlet side 36 which is exposed to ambient air in use. Conversely, an opposite side 38 of the filter 32 forms the outlet for the filter 32. Consequently, airflow passing from the inlet side 36 of the air filter 32 and to the outlet at the opposite side 38 passes through the air filter 32 which contain filter media designed to remove contaminants from the air.

In the conventional fashion, the air filtration mask 34 includes a valve 40 (FIG. 4) which automatically closes once the filter associated with the filter port is removed. Consequently, the replacement filler 32 includes a ring 42 (FIG. 2) which automatically engages and opens the valve upon attachment of the new clean filter. The filter 32 also includes a pair of arcuate slots 44 an its inlet side 36. These arcuate slots 44 are utilized to attach different accessories to the filter 32.

Referring again to FIG. 2, the device 10 of the present invention includes a pair of locking tabs 46 which are designed to be slidably received in one end of the attachment slots 44 in the tilter 32. Consequently, with the side 18 of the housing 12 positioned over at least a portion of the inlet side 36 of the filter 32 and the locking tabs 46 are received within the slots 44, rotation of the device 10 relative to the filter 32 detachably couples the device 10 to the replacement filter 32 and with the airflow outlet 16 open to at least a portion of the inlet side 36 of the filter 32.

In operation, the saturated filter on the air filtration mask 34 is first removed. Upon removal, the valve 40 in the attachment port of the mask 34 automatically closes and prevents contaminants from entering into the interior of the mask through the port when the contaminated filter is removed for replacement. Various cavities that form a part of the air filtration mask connection port for the filter 32, however, are both exposed to contaminants within the ambient air and those contaminants collect within the cavities around the connection port in the mask 34.

The device housing 12 is then attached to a clean filter 32 through the locking tabs 46 and attachment slots 44 in the filter 32. The electric switch 30 is then closed to an on position which connects power to the electric motor which, in turn, rotatably drives the impeller 24.

With the impeller 24 rotatably driven, the impeller 24 creates an airflow out the outlet 16 of the airflow passageway 14. This airflow passes through the filter 32 which flushes away and removes any contaminants contained with the airflow. The now clean air exiting out through the outlet side 38 of the filter 32 flushes the cavities present in the attachment port of the mask 34 with clean air thus removing most, if not all, of the contaminants from those cavities. Consequently, when the filter 32 is attached to the mask 34 substantially only clean air enters into the interior of the mask. The impeller 24 is then stopped by switching the switch 30 to an off position and the device 10 removed from the now installed clean filter for subsequent use when a filter change is desired.

Figure 5:
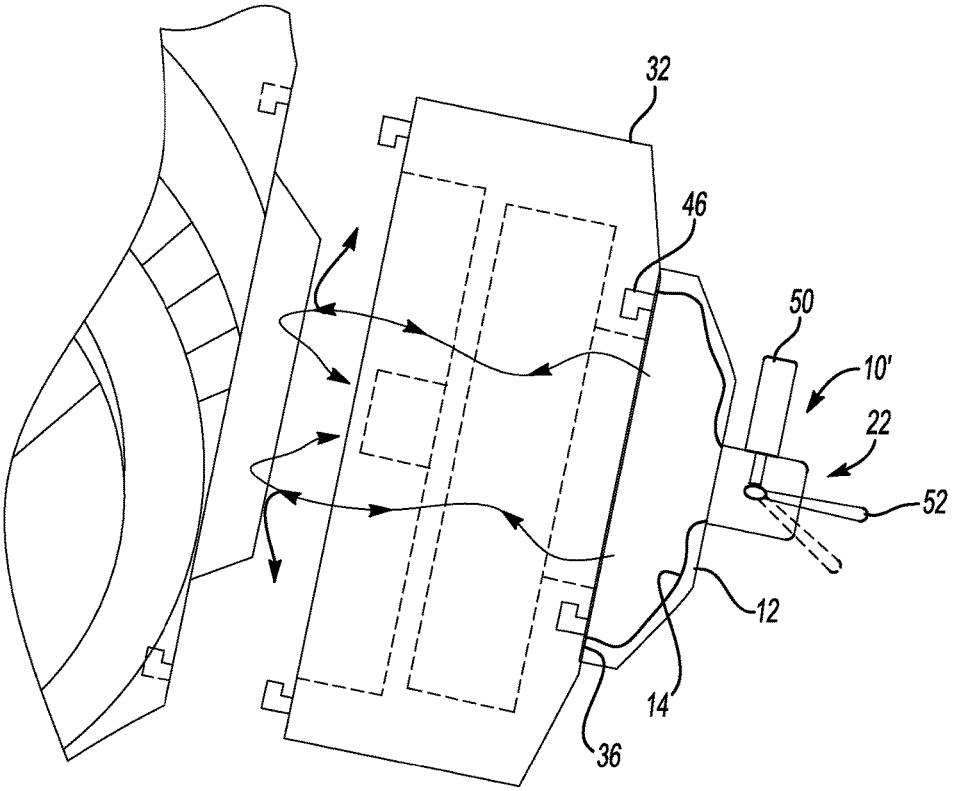
FIG. 5 is a view similar to FIG. 3, but illustrating a second embodiment.

With reference now to FIG. 5, a second preferred embodiment of the device 10' of the present invention is shown. As previously described, the device 10' includes a housing 12 which is attached to the inlet side 36 of the air filter 32 using the previously described locking tabs 46 so that the outlet 16 of the airflow passageway 14 overlies at least a portion of the inlet side 36 of the filter 32.

The device 10' differs, however, from the device 10 illustrated in FIGS. 1-3 and previously described, in the construction of its airflow mechanism 22. More specifically, the device 10' uses a source 50 of compressed gas, preferably compressed air, coupled to the airflow passageway 14 by a fluid valve 52. When the valve 52 is moved from its closed position, illustrated in solid line in FIG. 5, to its open position, illustrated in phantom line in FIG. 5, air from the compressed air source 50 flows through the passageway 14 and out through the outlet side 18 of the filter 32 thus flushing contaminants from the cavities around the mask connection port during attachment of the replacement filter to the mask. After attachment, the valve 52 is closed and the device housing removed. In all other respects, however, the device 10' is the same as the device 10 previously described and which description will not be repeated.

The compressed air source 50 may take any of several forms. For example, the compressed gas source 50 may be an inflatable bladder, a pressurized air bottle or canister, and/or the like.

From the foregoing, it can be seen that the present invention provides a simple, yet effective, apparatus and method for minimizing the entry of contaminants into an air filtration mask during a filter change. Having described our invention, however, many modifications thereto will become apparent to those of skill in the art to which it pertains without deviation from the spirit of the invention as defined by the scope of the appended claims.

We claim:

1. A method of replacing a filter on an air filtration mask, comprising the steps of:

attaching a housing to an inlet side of a clean filter so that an outlet of an airflow passageway through said housing overlies at least a portion of the inlet side of the clean filter, an inlet to the airflow passageway being open to ambient air, removing the filter to be replaced, flowing a gas through the airflow passageway while attaching the clean filter to the air filtration mask so that clean air is exiting through an outlet side of the clean filter while it is being attached to the air filtration mask, then stopping the flow of gas once the clean filter is attached to the air filtration mask, and detaching the housing from the clean filter, such that the housing is only attached to a filter during replacement.

2. The method a defined in claim 1, wherein said flowing step comprises the step of rotatably driving an impeller associated with said airflow passageway.

3. The method as defined in claim 2, wherein an electric motor is drivingly connected to said impeller and wherein said driving step comprises the step of electrically connecting the electric motor to an electric power source.

4. The method as defined in claim 1, and comprising a source of compressed air coupled to the airflow passageway through a valve and wherein said flowing step comprises the step of opening the valve.

5. The method as defined in claim 4, wherein said source of compressed air comprise an inflatable bladder.

6. The method as defined in claim 4, wherein said source of compressed air comprises a canister containing pressurized gas.

7. The method as defined in claim 1, wherein the gas comprises air.

* * * * *